US007365648B2

(12) United States Patent
Siber et al.

(10) Patent No.: US 7,365,648 B2
(45) Date of Patent: Apr. 29, 2008

(54) FIRE ALARM

(75) Inventors: Bernd Siber, Glonn (DE); Stefan Sittenauer, Munich (DE); Gottfried Ernst, Andechs (DE); Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 191 days.

(21) Appl. No.: 11/011,548

(22) Filed: Dec. 14, 2004

(65) Prior Publication Data

US 2005/0156747 A1 Jul. 21, 2005

(30) Foreign Application Priority Data

Jan. 16, 2004 (DE) ..... 10 2004 002 591

(51) Int. Cl.
*G08B 17/10* (2006.01)

(52) U.S. Cl. ..... 340/630; 340/693.11; 340/577; 340/578; 340/628; 340/632; 340/633

(58) Field of Classification Search ..... 340/630, 340/693.11, 577, 578, 628, 632, 633, 606, 340/60

See application file for complete search history.

(56) References Cited

U.S. PATENT DOCUMENTS 4,616,928 A * 10/1986 Leavitt et al. ..... 356/338
4,906,978 A 3/1990 Best et al.
5,138,302 A * 8/1992 Nagaoka et al. ..... 340/630
6,300,876 B1 * 10/2001 Sakurai et al. ..... 340/630
2003/0215766 A1 * 11/2003 Fischer et al. ..... 433/29
2005/0143717 A1 * 6/2005 Peyman ..... 606/5

FOREIGN PATENT DOCUMENTS

DE 199 12 911 10/2000
DE 100 46 992 6/2002
JP 55-036785 3/1980

* cited by examiner

*Primary Examiner*—Tai Nguyen
(74) *Attorney, Agent, or Firm*—Kenyon & Kenyon LLP

(57) ABSTRACT

A fire alarm for an installation via a housing that is flush with the ceiling, having at least one light source arranged in the housing and at least one light receiver arranged in the housing, as well as a shutter disk, which seals the housing. To prevent the spreading of stray light between the light source and the light receiver via the shutter disk, a shield, for example, is provided in the shutter disk to suppress or absorb stray light.

21 Claims, 4 Drawing Sheets

FIRE ALARM

CROSS-REFERENCE TO RELATED APPLICATIONS

The present invention claims priority from German Application No. 102004002591.6 filed on Jan. 16, 2004.

BACKGROUND INFORMATION

From German Patent No. DE 199 12 911 an optical fire alarm is known, which includes a radiation transmitter and a radiation receiver and requires no optical labyrinth, so that it is able to be installed in a room ceiling in a flush manner. The fire alarm also encompasses an arrangement by which, first of all, soiling of the transparent shutter disk of the fire alarm can be detected and, secondly, the proper operation of the radiation transmitter and radiation receiver of the fire alarm provided to detect smoke can be monitored.

From German Patent No. DE 100 46 992 a fire alarm is known which has an arrangement by which smoke and other foreign bodies in the scatter volume can be distinguished.

SUMMARY OF THE INVENTION

Fire alarms that are able to be installed in a room ceiling in a flush manner have the advantage of being integrated in the ceiling inconspicuously and, in contrast to fire alarms of the conventional type, have the advantage of blending in, which architects and building designers prefer. The flush installation in the room ceiling requires that such fire alarms have a flat, smooth surface. This is made possible by a shutter disk which seals the housing of the fire alarm. The shutter disk is transparent with respect to the light utilized in the scattered light measurement so that this light emitted by a light source may reach the light receiver after being reflected at smoke particles. The present invention offers the advantage that extraneous stray light, which travels directly from the light source to the light receiver via the shutter disk, is largely suppressed. This considerably improves the signal/noise ratio.

In a first exemplary embodiment of the present invention, the spread of stray light is prevented by shielding means, which are arranged in the shutter disk itself and thereby interrupt the optical path between the light source and the light receiver. In another exemplary embodiment of the present invention, at least partial areas of at least one surface of the shutter disk are designed such that stray light spreading in the shutter disk is absorbed or made to leave the shutter disk before reaching the light receiver via the shutter disk. Especially suitable is a shutter disk whose surfaces are roughened in a central partial area and polished in a peripherally adjacent partial area, the polished partial area concentrically surrounding the roughened partial area. Stray light is absorbed in a particularly efficient manner due to the fact that a coating which absorbs stray light has been applied on at least a partial area of at least one surface of the fire alarm. Especially suitable for such a coating is a colored foil. However, it is useful if this foil is dyed only in a central region and is transparent in an adjoining edge region. Shutter disks made up of several layers are also very useful, the layer structure being produced by an injection-molding process.

DETAILED DESCRIPTION

Figure 1:
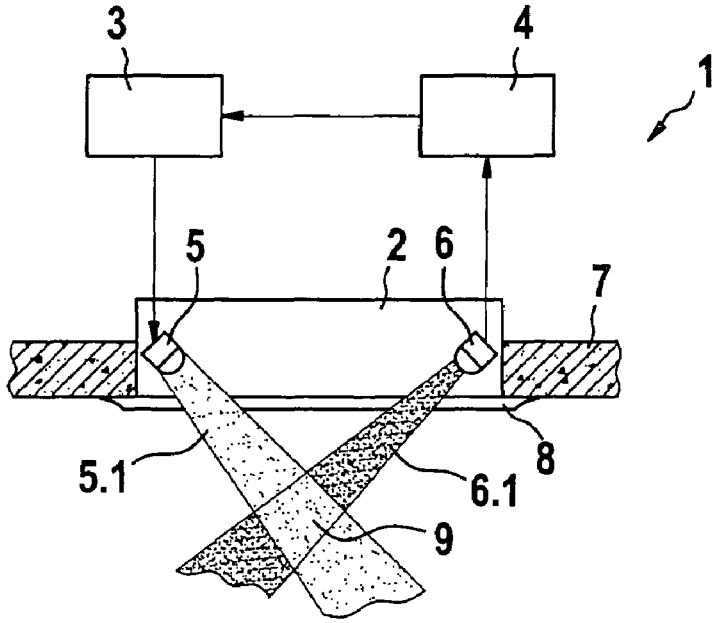
FIG. 1 shows the basic structure of a fire alarm that is flush with the ceiling, in a block diagram.

FIG. 1 shows the basic structure of a fire alarm 1 according to the stray-light principle. Fire alarm 1 includes a housing 2, which is disposed in a flush manner in a corresponding recess of ceiling 7 of a room. Housing 2 is covered by a shutter disk 8. A light source 5 and a light receiver 6 are arranged inside housing 2 in such a way that no light is able to travel from light-source 5 to light receiver 6 on the direct path. Light source 5 and light receiver 6 are instead arranged such that their optical paths 5.1, 6.1 intersect outside shutter disk 8. This intersection area is referred to as scatter volume 9. If stray particles such as smoke generated by a fire source enter this scatter volume 9, the light emitted by light source 5 is scattered at the smoke. A portion of the scattered radiation reaches light receiver 6 in this manner. The amount of stray radiation that is scattered to light receiver 6 at a given brightness of light source 5 by smoke particles depends on the characteristics of the smoke (in particular on the particle size), on the color of the smoke, the wavelength of the utilized light and on the scattering angle. The scattering angle is the angle between the optical axis of light source 5 and the optical axis of light receiver 6. Light source 5 is controlled by a microcomputer 3. Radiation receiver 6 is connected to an electronic circuit system 4, which essentially includes amplification and filter means. The amplified scattered light signal is able to be read in and analyzed by microcomputer 3 via an A/D converter (not shown here). If the scattered light signal exceeds a certain predefinable threshold, fire alarm 1 will trigger an alarm. This alarm is expediently passed along via a bus system to a fire alarm center, from where the fire fighters are then summoned.

To prevent malfunctions of fire alarm 1 due to extraneous ambient light, conventional fire alarms enclose light source and light receiver by a cover, which does allow smoke particle to pass through, but prevents the passage of extraneous light. Because of the shape of such covers, they are commonly referred to as "labyrinth". The sensitivity of such fire alarms is high, so that care must be taken in labyrinth covers that no stray light impinges upon the light receiver by reflection from the chamber walls of the labyrinth. The constructive design of such covers is correspondingly complex. The smoke entry openings of labyrinths are usually provided with a screen to prevent insects from penetrating into the measuring chamber and causing interference signals.

In a fire alarm that is flush with the ceiling and operates without optical labyrinth, a shutter disk 8 which is transparent with respect to the light emanating from light source 5 suffices as cover. For instance, if infrared light is emitted by light source 5, shutter disk 8 must be transparent only with respect to this light and for this purpose may be provided with a daylight filter, for instance, which absorbs visible light, so that it cannot impinge on light receiver 6. If visible light is used for the scattered-light measurement, such a daylight filter cannot be utilized. A shutter disk is desirable since it offers protection from dust and other external influences to light source 5 and light receiver 6 situated behind the shutter disk. Inside fire alarm 1, a shield 10 (FIG. 2) separates light transmitter 5 and light receiver 6 from one another.

Figure 2:
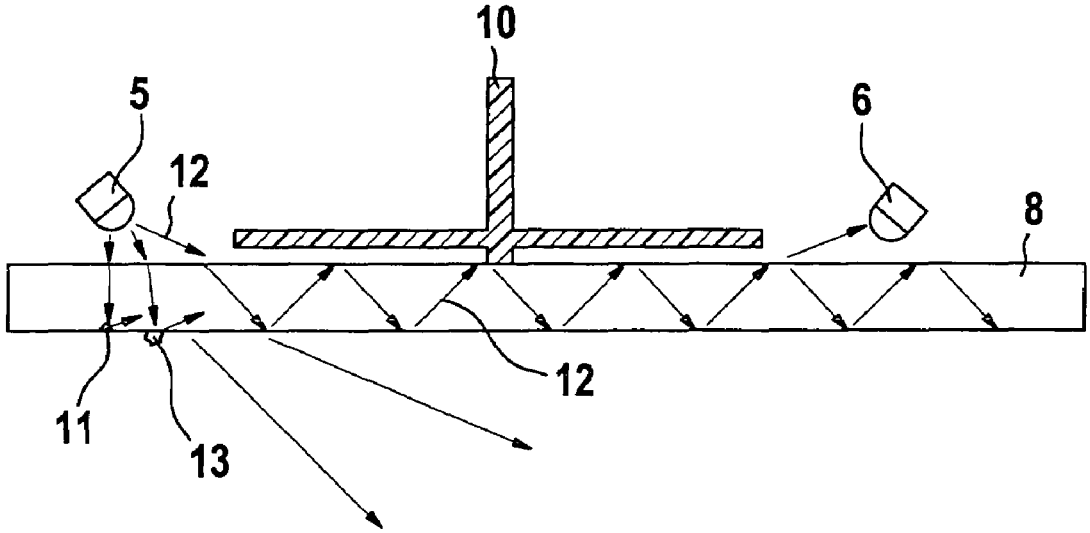
FIG. 2 shows the structure of the shutter disk acting as an optical waveguide for stray light.

However, using such shutter disks 8 entails the following problem. The light emanating from light source 5 must pass through shutter disk 8. Light is reflected at all boundary surfaces between two optical media as a function of the magnitude of the refractive index and the angle of incidence. As shown in FIG. 2, this inevitably couples light into shutter disk 8. Although the condition for total reflection is not satisfied in this case, the light is able to be reflected back and forth multiple times inside shutter disk 8, with decreasing intensity, and leave shutter disk 8 again in the sensitivity region of light receiver 6. In addition, by interferences on the surface of shutter disk 8 such as scratches 11 and dust particles 13, light is coupled into shutter disk 8 at an angle that satisfies the condition for total reflection. Shutter disk 8 acts as a waveguide for this portion of the light. The light decoupled at the location of light receiver 6 increases the quiescent signal of light receiver 6. As a result of the aforementioned effects the quiescent signal of light receiver 6 may become so great that the resolution of the A/D converter provided for the processing of the output signal of light receiver 6 is no longer adequate to sufficiently resolve the useful signal (the light scattered by the smoke), which is now very small relative to the quiescent signal.

The present invention avoids this disadvantage. The provided solutions ensure a sufficiently large signal/noise clearance by suppression of extraneous light and thus allow a reliable operation of a fire alarm 1.

Figure 3:
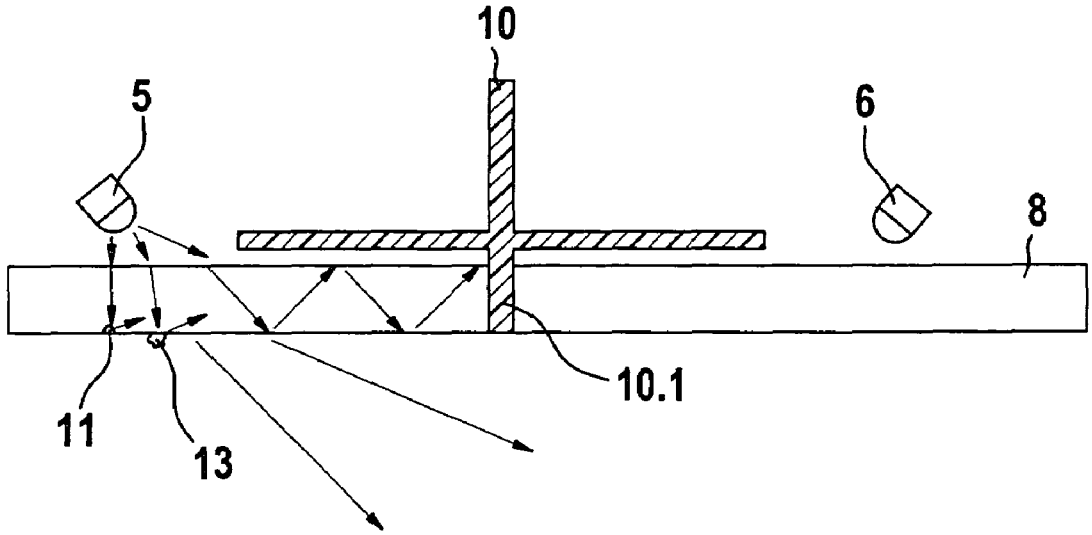
FIG. 3 shows a first exemplary embodiment of the present invention with a shielding means arranged inside the shutter disk.

A first exemplary embodiment of the present invention (FIG. 3) provides a shield 10.1 as well, which is situated inside shutter disk 8 and, in one exemplary embodiment, may be connected to shield 10, which separates light source 5 and light receiver 6. This shield acts as a barrier that is impenetrable by the light emanating from light source 5. A certain disadvantage of this solution is that this shield 10.1 changes the look of fire alarm 1 and may therefore be considered distracting.

Figure 4:
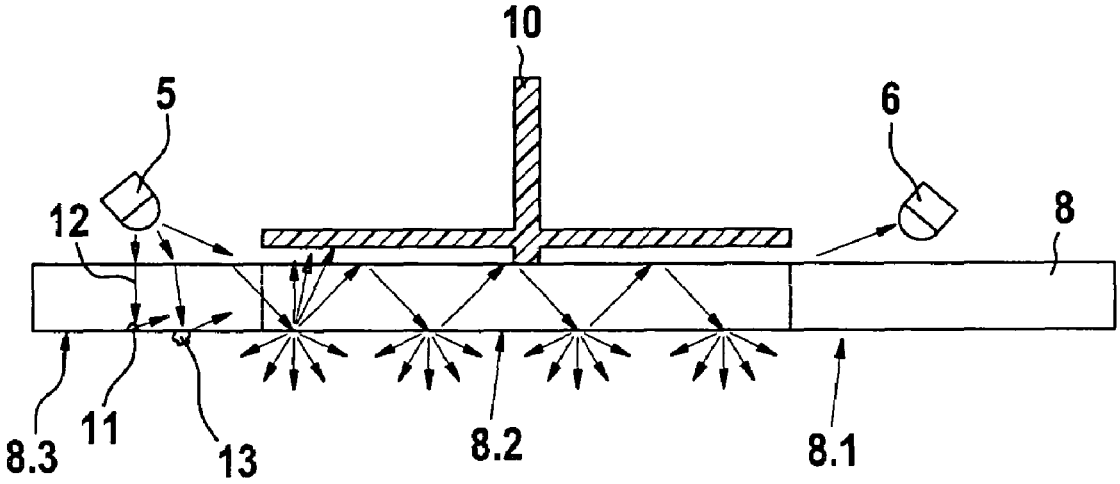
FIG. 4 shows another exemplary embodiment of the present invention in which at least a partial area of at least one surface of the shutter disk is roughened.

Another variant of an embodiment is discussed in the following with reference to FIG. 4. A further possibility for the selective decoupling of extraneous light from shutter disk 8 is that at least a partial area 8.1 of shutter disk 8 is provided with a rough surface structure, either only on one surface or, even better, on both surfaces. Light is decoupled from shutter disk 8 at this rough surface structure. Since the quality of shutter disk 8 as optical waveguide is considerably reduced by this rough surface, virtually no extraneous light reaches light receiver 6 anymore. In contrast, partial areas 8.1 and 8.3 of shutter disk 8 directly in front of light transmitter 5 and light receiver 6 must have a smooth, polished surface, so that the light emanating from light source 5 is not coupled into shutter disk 8 due to a rough surface, or that the light in shutter disk 8 at the location of light receiver 6 is not coupled out. In addition to the roughness of the surface, the color of the shield situated in housing 2 on the rear of shutter disk 8 plays an important role as well. For, due to the rough surface of shutter disk 8, the light is dispersed in various directions, so that a portion of the light on the rear side of shutter disk 8 leaves shutter disk 8 and impinges upon shield 10. If a light color is used for this shield 10, the light exiting shutter disk 8 is not reflected by this shield, but is partially reflected back to shutter disk 8 where it is coupled in again. Another advantage of this measure is that shutter disk 8 need not be constructed of two different materials as is the case in the first exemplary embodiment. Shutter disk 8 may thereby be produced in a simpler and thus more cost-effective manner. However, the look of fire alarm 1 is still heavily influenced by these measures. Another disadvantage is that dirt and dust adhere more readily to a rough surface than to a polished surface. A fire alarm which is flush with the sealing and includes a shutter disk 8 having a rough surface, is therefore more susceptible to soiling and must possibly be cleaned and serviced more often.

Figure 5:
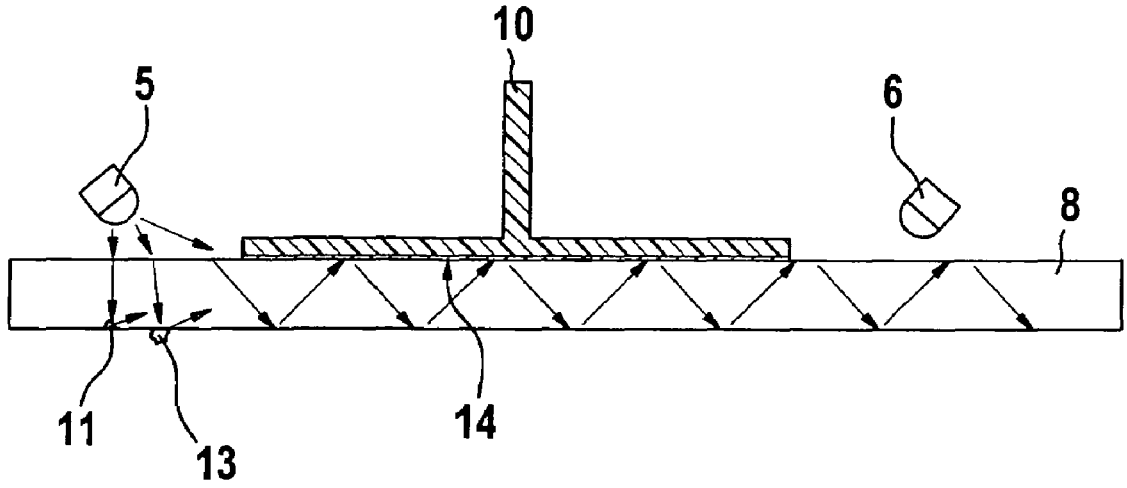
FIG. 5 shows another exemplary embodiment of the present invention with an absorbent coating arranged on at least one surface of the shutter disk.

In another advantageous specific embodiment of the present invention (FIG. 5) stray light is suppressed in that a coating 14 is applied on the back of shutter disk 8. This coating 14 may be made of a colored enamel layer, for instance. It is true that a total reflection of the light may still occur on the non-enameled outer surface of shutter disk 8 at the boundary surface between the surface of shutter disk 8 (refractive index n=1.5) and the air (n=1). However, this is no longer the case on the enameled side of shutter disk 8 since the refractive index of the enamel>1. For this reason, the light coupled into shutter disk 8 impinges on coating 14 where it is at least partially absorbed (again depending on the color of the coating). After several reflection processes at coating 14, the light is absorbed nearly completely. One advantage of this specific embodiment is that the look of fire alarm 1 is virtually unaffected. Therefore it is very easy to integrate its design in room ceiling 7. A suitable coating 14 may be applied on shutter disk 8 in a variety of ways.

It is advisable to produce shutter disk 8 from a transparent plastic material by an injection-molding process. In the process, a colored foil is first inserted in the injection-molding tool and liquid plastic subsequently injected into the injection-molding tool. The liquid plastic combines with the colored foil. After hardening, shutter disk 8 is obtained, which is covered by a colored foil in its central region.

Figure 6:
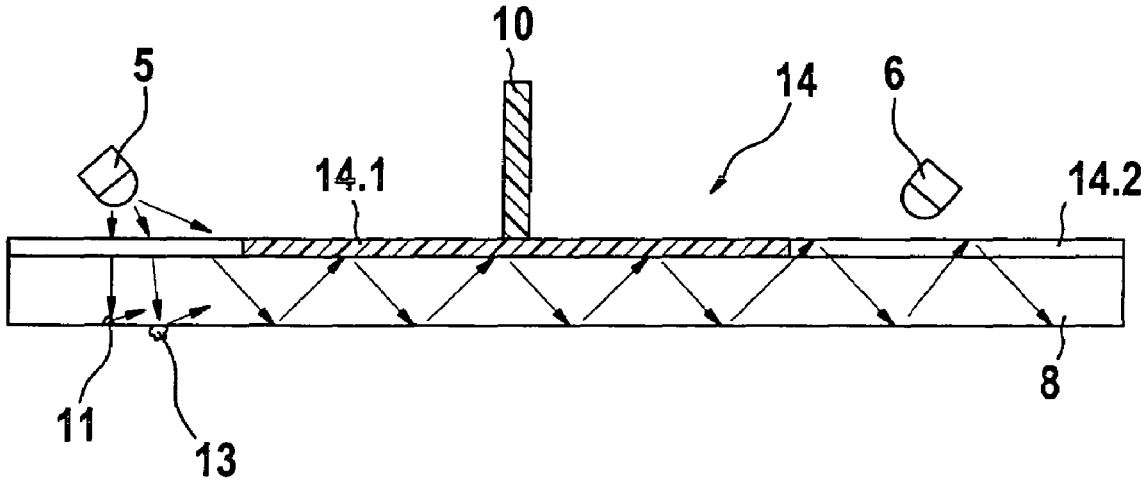
FIG. 6 shows another exemplary embodiment of the present invention with a foil arranged on the shutter disk.
Figure 7:
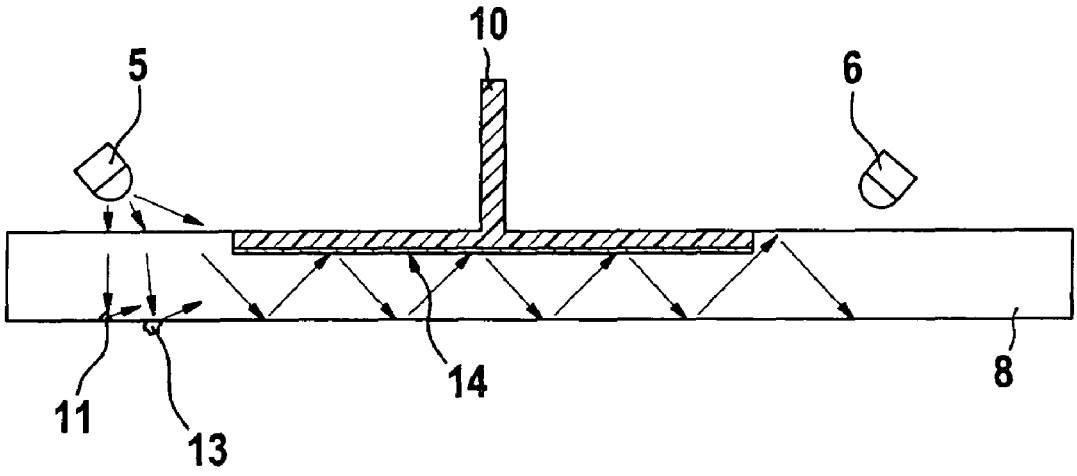
FIG. 7 shows a shutter disk having a multi-layered structure.

Furthermore, in a second method (FIG. 6), a coating 14 in the form of a multi-colored foil may be applied on shutter disk 8. The foil is dyed in a central region 14.1, whereas it is transparent in an edge region 14.2 and essentially has the same refractive index as the material of shutter disk 8.

Finally, in a third method, shutter disk 8 may also be produced in two consecutive injection processes, in which a transparent and a colored plastic are utilized. However, in this method a minimum thickness (as a function of the size of the extruded areas) must be ensured for both plastic layers.

Figure 8:
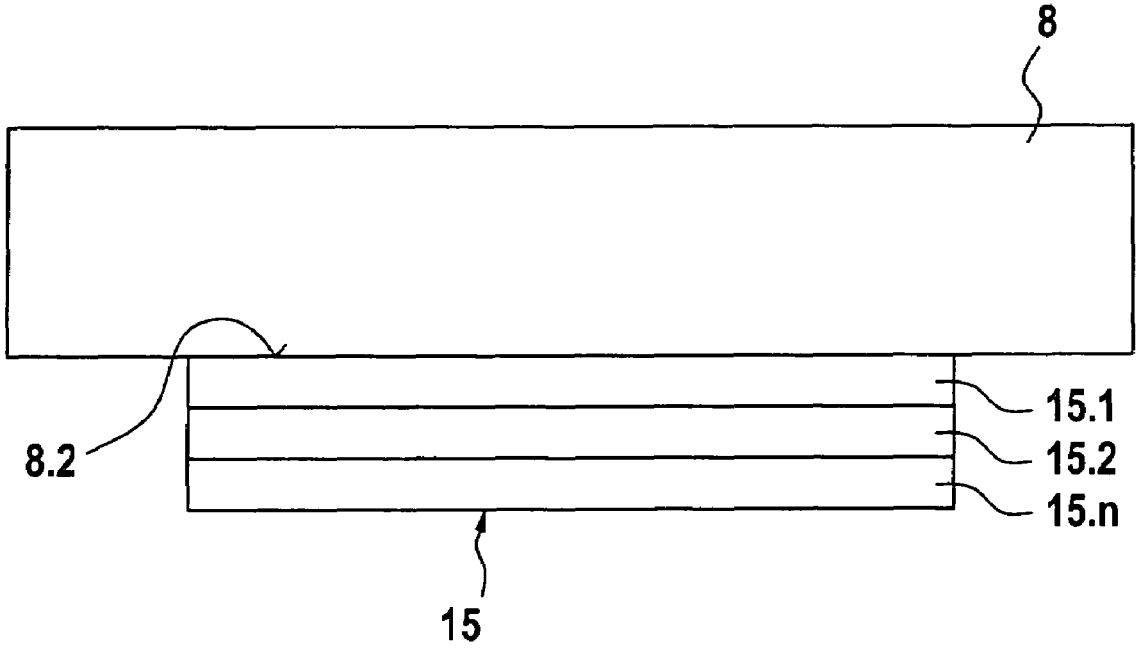
FIG. 8 shows a shutter disk having multiple coatings.

In an advantageous further exemplary embodiment of the present invention (FIG. 8), extraneous stray light may also be effectively suppressed by the application of a multiple coating 15, 15.1, 15.2, 15n on at least one partial area 8.2, whereby stray radiation is canceled or selectively coupled out of shutter disk 8 by interference processes taking place there. Multiple coating 15 is made up of a multitude of thin, dielectric layers 15.1, 15.2, 15.n, which are suitably vapor-deposited on a surface of shutter disk 8 in a vacuum.

What is claimed is:

1. A fire alarm for an installation via a housing that is flush with a ceiling, comprising:

at least one light source situated in the housing;

at least one light receiver situated in the housing;

a shutter disk for sealing the housing; and a shielding device situated inside the shutter disk for preventing a spread of stray light between the light source and the light receiver via the shutter disk.

2. The fire alarm according to claim 1, further comprising a light-absorbing coating applied on at least a partial area of at least one surface of the fire alarm.

3. The fire alarm according to claim 2, wherein the light-absorbing coating is a colored foil.

4. The fire alarm according to claim 3, wherein the foil is dyed in a central region and is transparent in an adjoining edge region.

5. The fire alarm according to claim 1, wherein the shutter disk is composed of multiple layers.

6. The fire alarm according to claim 5, wherein the multiple layers of the shutter disk are produced by injection molding.

7. A fire alarm for an installation via a housing that is flush with a ceiling, comprising:

at least one light source situated in the housing;

at least one light receiver situated in the housing;

a shutter disk for sealing the housing; and a shielding device situated inside the shutter disk for preventing a spread of stray light between the light source and the light receiver via the shutter disk;

wherein at least one surface of the shutter disk is polished in a first partial area and is roughened in a second partial area.

8. The fire alarm according to claim 7, wherein the polished partial area concentrically surrounds the roughened partial area.

9. The fire alarm according to claim 7, wherein the polished partial area is situated in an optical path of the light source and the light receiver.

10. The fire alarm according to claim 1, wherein the shutter disk has a multiple coating, which one of (a) cancels stray light by interference and (b) decouples stray light from the shutter disk.

11. A fire alarm for an installation via a housing that is flush with a ceiling, comprising:

at least one light source situated in the housing;

at least one light receiver situated in the housing; and a shutter disk for sealing the housing, wherein at least partial areas of at least one surface of the shutter disk are designed such that stray light spreading in the shutter disk is one of (a) absorbed in the partial areas and (b) induced to exit the shutter disk;

wherein at least one surface of the shutter disk is polished in a first partial area and is roughened in a second partial area.

12. The fire alarm according to claim 11, wherein the polished partial area concentrically surrounds the roughened partial area.

13. The fire alarm according to claim 11, wherein the polished partial area is situated in an optical path of the light source and the light receiver.

14. A fire alarm for an installation via a housing that is flush with a ceiling, comprising:

at least one light source situated in the housing;

at least one light receiver situated in the housing; and a shutter disk for sealing the housing, wherein at least partial areas of at least one surface of the shutter disk are designed such that stray light spreading in the shutter disk is one of (a) absorbed in the partial areas and (b) induced to exit the shutter disk, and wherein a light-absorbing coating is applied on at least a partial area of at least one surface of the fire alarm.

15. The fire alarm according to claim 14, wherein the light-absorbing coating is a colored foil.

16. The fire alarm according to claim 15, wherein the foil is dyed in a central region and is transparent in an adjoining edge region.

17. A fire alarm for an installation via a housing that is flush with a ceiling, comprising:

at least one light source situated in the housing;

at least one light receiver situated in the housing; and a shutter disk for sealing the housing, wherein at least partial areas of at least one surface of the shutter disk are designed such that stray light spreading in the shutter disk is one of (a) absorbed in the partial areas and (b) induced to exit the shutter disk, and wherein the shutter disk is composed of multiple layers.

18. The fire alarm according to claim 17, wherein the multiple layers of the shutter disk are produced by injection molding.

19. A fire alarm for an installation via a housing that is flush with a ceiling, comprising:

at least one light source situated in the housing;

at least one light receiver situated in the housing; and a shutter disk for sealing the housing, wherein at least partial areas of at least one surface of the shutter disk are designed such that stray light spreading in the shutter disk is one of (a) absorbed in the partial areas and (b) induced to exit the shutter disk, and wherein the shutter disk has a multiple coating, which one of (a) cancels stray light by interference and (b) decouples stray light from the shutter disk.

20. A fire alarm for an installation via a housing that is flush with a ceiling, comprising:

at least one light source situated in the housing;

at least one light receiver situated in the housing;

a shutter disk for sealing the housing; and a shielding device situated inside the shutter disk for preventing a spread of stray light between the light source and the light receiver via the shutter disk;

wherein the at least one light source and the at least one light receiver are positioned in such a way that optical paths of the at least one light source and the at least one light receiver intersect outside the shutter disk.

21. A fire alarm for an installation via a housing that is flush with a ceiling, comprising:

at least one light source situated in the housing;

at least one light receiver situated in the housing; and a shutter disk for sealing the housing, wherein at least partial areas of at least one surface of the shutter disk are designed such that stray light spreading in the shutter disk is one of (a) absorbed in the partial areas and (b) induced to exit the shutter disk, and wherein the at least one light source and the at least one light receiver are positioned in such a way that optical paths of the at least one light source and the at least one light receiver intersect outside the shutter disk.

* * * * *